US006061545A

United States Patent [19]

Cerrah

[11] Patent Number: 6,061,545

[45] Date of Patent: May 9, 2000

[54] EXTERNAL HEAT MEMBER WITH FLUOROPOLYMER AND CONDUCTIVE FILLER OUTER LAYER

[75] Inventor: Ken M. Cerrah, Fairport, N.Y.

[73] Assignee: Xerox Corporation, Stamford, Conn.

[21] Appl. No.: 09/215,814

[22] Filed: Dec. 18, 1998

[51] Int. Cl.[7] ..... G03G 15/20

[52] U.S. Cl. ..... 399/330; 219/216; 399/333; 432/60

[58] Field of Search ..... 399/328, 329, 399/330, 333; 219/216; 430/99, 124; 432/60

[56] References Cited

U.S. PATENT DOCUMENTS

| | | | |
|---|---|---|---|
| 3,452,181 | 6/1969 | Stryjewski | 219/216 |
| 4,071,735 | 1/1978 | Moser | 219/216 |
| 4,372,246 | 2/1983 | Azar et al. | 118/60 |
| 5,248,339 | 9/1993 | Fitzgerald et al. | 118/60 |
| 5,291,257 | 3/1994 | Cerrah et al. | 355/290 |
| 5,349,424 | 9/1994 | Dalal et al. | 355/285 |
| 5,729,813 | 3/1998 | Eddy et al. | 399/333 |

FOREIGN PATENT DOCUMENTS

| | | |
|---|---|---|
| 1-52184 | 2/1989 | Japan . |

*Primary Examiner*—Joan Pendegrass
*Attorney, Agent, or Firm*—Annette L. Bade; Judith L. Byorick

[57] ABSTRACT

An external heat member having a) a heat source, b) a substrate; and thereover c) an outer fluoropolymer layer with a fluoropolymer and a conductive filler, and in a preferred embodiment, the conductive filler is a relatively small particle size silicon carbide.

22 Claims, 3 Drawing Sheets

EXTERNAL HEAT MEMBER WITH FLUOROPOLYMER AND CONDUCTIVE FILLER OUTER LAYER

BACKGROUND OF THE INVENTION

The present invention relates to fuser apparatuses and fusing members thereof, in electrostatographic reproducing, including digital and image-on-image, apparatuses. The fuser member is especially useful for fusing color images. More specifically, the present invention relates to apparatuses directed towards fusing toner images using an external fusing member to aid in maintaining sufficient heat to the fuser member. In preferred embodiments, the external fusing member has an outer fluoropolymer layer. In a particularly preferred embodiment, the fluoropolymer outer layer is filled with a conductive filler, preferably silicon carbide. In a particularly preferred embodiment, the to silicon carbide filler has a very fine particle size of less than about 10 microns.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be the photosensitive member itself or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes it to be firmly bonded to the support.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. Heat may be applied to the fuser members by internal and/or external sources.

In color copying and printing, normally customer preference for color prints is a high gloss or matte opaque finish. This usually requires the use of smooth, conformable fuser roll operating at a high temperature and having a long-dwell nip. In addition, extra release agent is necessary for improving toner release due to the increase in toner used for color developing. For developing color images, several layers of different color toner are deposited on the latent image resulting in extra thickness (higher toner pile height) of unfused toner on a color image. Therefore, a higher operating temperature for color fusers is necessary to fuse the additional amount of toner. Also, as the need for increased speed and production in copying and printing occurs, it is desired that the fusing temperature remains elevated for longer time periods.

If the temperature of the fusing member is increased to the point necessary for color fusing, a problem frequently encountered is that the copy substrate, e.g. a sheet of paper, on which the toner image is fused, may curl and/or adhere to the heated fuser. Such adhering paper will tend to wrap itself around the fuser and thus prevent the fuser from performing its intended operations in subsequent copying cycles. Such adhering paper must be generally removed by hand, resulting in manual labor, machine downtime, and customer dissatisfaction.

Another feature common to most of the prior art fusing members is that the source of the heat energy for the fusing operation is generally in the form of a quartz lamp positioned in the core of a fuser roll. In such a configuration, the heat must be conducted from the core of the fuser member, through the various layers of materials comprising the fuser member, to the surface of the fuser member for fusing the toner image to the copy substrate. To obtain the proper higher fusing temperature needed for color fusing at the surface of such a fusing member, the temperatures at the various layers or points within the fuser member must be substantially higher. Since heat must be transmitted from the source in the core of the fuser member to its surface, it takes an appreciable amount of time before the surface of the fusing member is warmed up to the fusing temperature and thus ready for operations. This delay in readiness of the machine to fuse toner images, or the warm-up time, is accentuated by the fact that such fuser members are generally made of elastomeric or other polymeric materials which are generally poor conductors of heat.

To solve some of the above problems that occur with fuser members which require heating to such higher temperatures necessary in color fusing, an external heat member has been used. This external heat member is associated with the fusing member so as to provide additional heat to the surface of the fusing member to account for the additional surface heat necessary for color fusing.

U.S. Pat. No. 3,452,181 discloses a roll fusing device which is heated by both an internal heating element and an external auxiliary heating element. The fusing drum of this patent is made of a glass or quartz sleeve having a transparent silicon varnish layer thereon and offset-preventing silicone oil is applied to the surface of the silicone varnish layer.

U.S. Pat. No. 4,071,735 discloses an externally heated roll fuser, in which the heating element heats the fuser roll at the same time preheats the toner image to be fused. The fuser roll of this patent is made of a metallic core with a layer of heat insulating silicone rubber thereon.

U.S. Pat. No. 4,372,246 teaches an externally heated fuser member which comprises a base, a relatively thick layer of a foam of fluoroelastomer on the base and a relatively thin layer of a silicone elastomer on the foam layer. The silicone elastomer layer has an iron oxide filler dispersed therein.

U.S. Pat. No. 5,349,424 discloses a thick walled belt fusing system having an externally heated fuser roll associated therewith, for use in full color electrophotographic printing machines.

U.S. Pat. No. 5,291,257 discloses a composite pressure roll having a surface coating of a fluorocarbon polymer and an irregularly shaped, non-planar, inert filler having a hardness greater than 8 Mohs, and having a particle size of from about 10 to about 30 microns and present in the coating in an amount of from about 10 to about 40 percent by weight of total solids.

Although external heat members provide benefits to color fusing, such as increasing the temperature of the fuser member necessary for color fusing, problems with use of external heat members have arisen. For example, although the external heat roll increases heat to the surface of a fuser member, the heat transfer has been found to interfere with the release properties of the surface of the fuser member. Specifically, toner remaining on the fuser member following fusing can be transferred to the external heat member, and retransferred to the fusing member upon the next fusing cycle. Further, as the desire for faster copiers and printers increases, faster output is required and higher heat is required for the fusing system to maintain the increased speed. Further, sufficient heat at a required relatively high temperature must be maintained for longer periods of time. Even with the help of an external heating member, the temperature tends to decrease the longer the fuser member is in use. This is known as temperature droop.

It is desired to provide an external fuser member, wherein high quality color prints and/or copies are produced. Particularly, it is desired to provide an external fuser member demonstrating increased thermal conductivity and improved temperature control. More specifically, an external heat member which increases the temperature of the fusing member to the relatively high temperature necessary in color fusing, and which maintains the fuser member at that temperature for longer periods of time is desired. Further, it is desired to provide an external heat member which decreases the contamination to the fusing member.

SUMMARY OF THE INVENTION

In embodiments, the present invention relates to: an external heat member comprising: a) a heat source, b) a substrate; and thereover c) an outer fluoropolymer layer comprising a fluoropolymer and a thermally conductive filler.

Embodiments of the present invention further include: an image forming apparatus for forming images on a recording medium comprising: a charge-retentive surface to receive an electrostatic latent image thereon; a development component to apply toner to said charge-retentive surface to develop said electrostatic latent image to form a developed image on said charge retentive surface; a transfer component to transfer the developed image from said charge retentive surface to a copy substrate; and a fusing apparatus for fusing toner images to a surface of said copy substrate, wherein said fuser apparatus comprises a fuser member in combination with an external heat member, wherein said external heat member comprises a) a heat source, b) a substrate; and thereover c) an outer fluoropolymer layer comprising a fluoropolymer and a thermally conductive filler.

Also, embodiments further include: a fusing apparatus comprising a fuser member and an external heat member, wherein said external heat member comprises a) a heat source, b) a substrate; and thereover c) an outer fluoropolymer layer comprising a fluoropolymer and silicon carbide filler.

BRIEF DESCRIPTION OF THE DRAWINGS

For a better understanding of the present invention, reference may be had to the accompanying figures.

DETAILED DESCRIPTION OF THE PRESENT INVENTION

Figure 1:
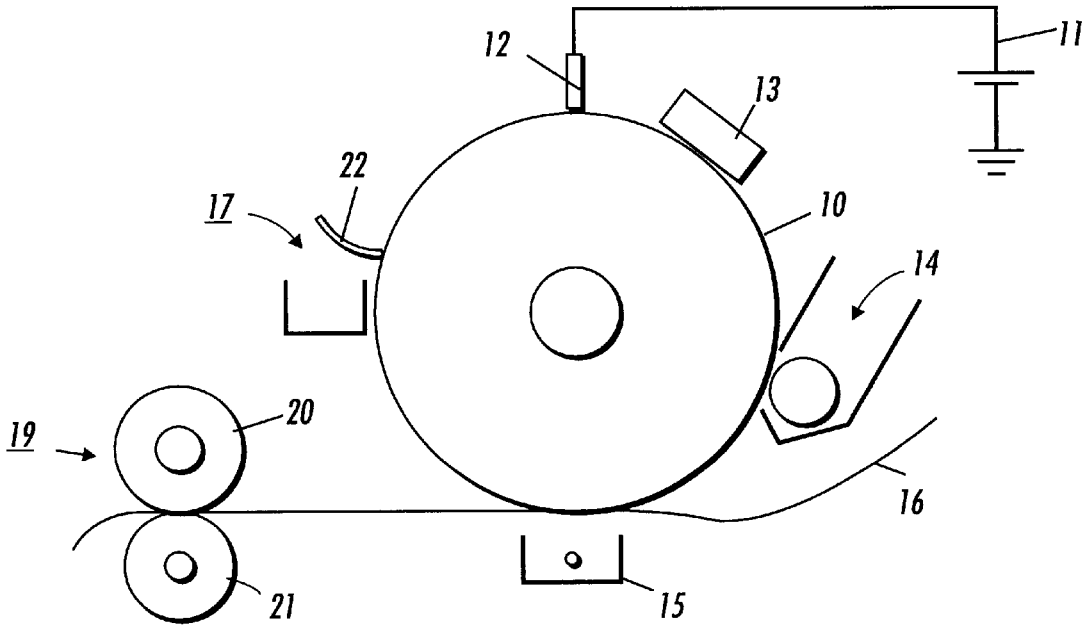
FIG. 1 is an illustration of a general electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
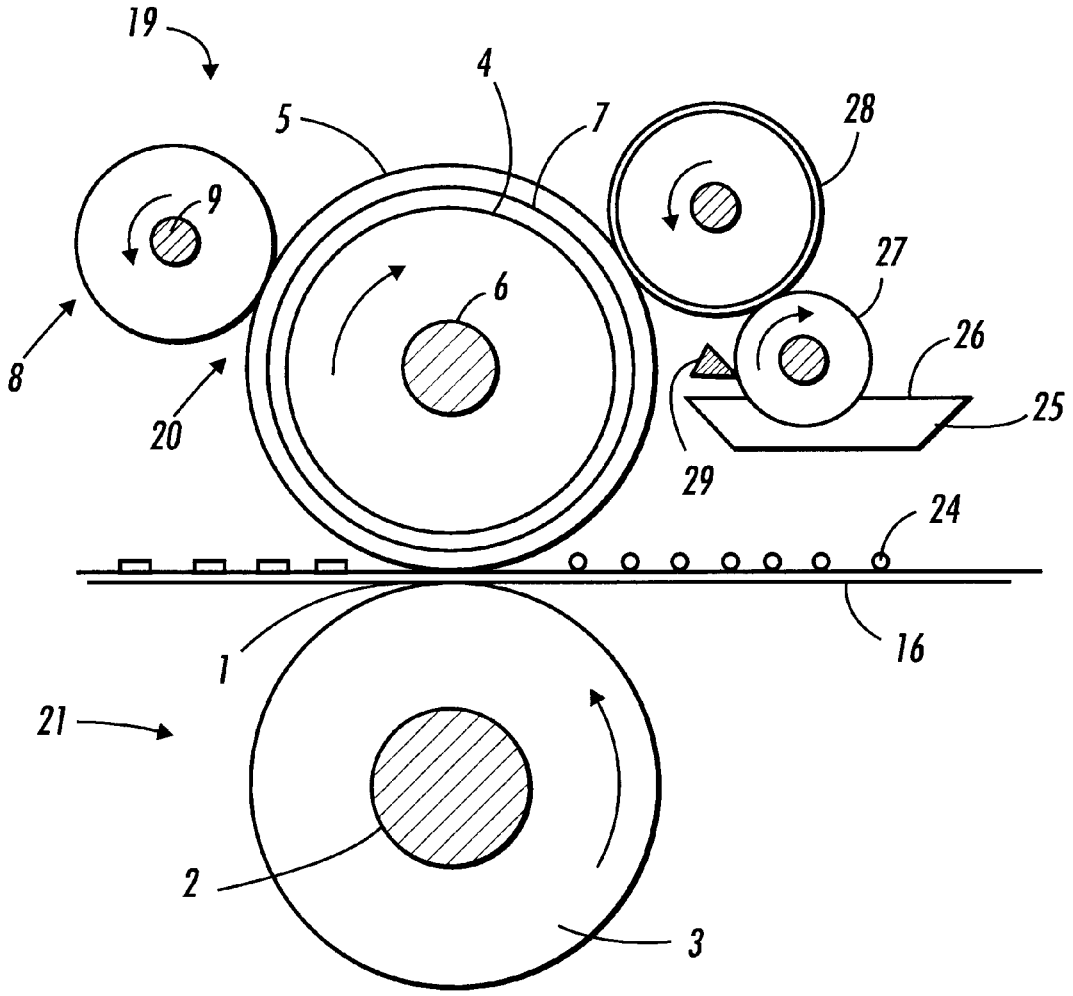
FIG. 2 illustrates a fusing system in accordance with an embodiment of the present invention.

Referring to FIG. 2, an embodiment of a fusing station 19 is depicted with an embodiment of a fuser roll 20 comprising polymer surface 5 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. The fuser member 20 can include an optional adhesive, cushion, or other suitable optional layer 7 positioned between core 4 and outer layer 5. Backup or pressure roll 21 cooperates with fuser roll 20 to form a nip or contact arc 1 through which a copy paper or other substrate 16 passes such that toner images 24 thereon contact polymer surface 5 of fuser roll 20. As shown in FIG. 2, an embodiment of a backup roll or pressure roll 21 is depicted as having a rigid metal core 2 with a polymer or elastomer surface or layer 3 thereon. Sump 25 contains polymeric release agent 26 which may be a solid or liquid at room temperature, but it is a fluid at operating temperatures. The pressure member 21 may include a heating element (not shown). Two release agent delivery rolls 27 and 28 rotatably mounted in the direction indicated are provided to transport release agent 26 to polymer surface 5.

External heat member 8, depicted as heat roller 8, having internal heating element 9 is also shown in FIG. 2. External heat member 8 is associated with fuser member 20. The external heat source may be a quartz lamp or any other suitable heat source. The external heat member is in direct contact with the fuser member. In other words, the external heat source touches the fuser member. The external heat member is in contact with the fuser member in a manner similar to that of a pressure member in combination with a fuser member.

Figure 3:
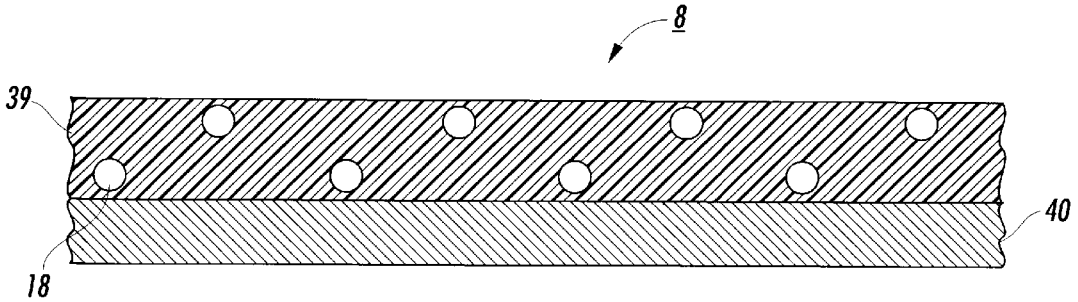
FIG. 3 demonstrates a cross-sectional view of embodiments of an external heat member substrate and outer layer of the present invention.

FIG. 3 depicts a cross-sectional view of a preferred embodiment of the invention, wherein external heat member 8 comprises substrate 40 and outer layer 39 with fillers 18 dispersed or contained therein. An optional primer layer or adhesive layer can be positioned between the substrate 40 and outer layer 39.

Fuser member as used herein refers to fuser members including fusing rolls, belts, films, sheets and the like; donor members, including donor rolls, belts, films, sheets and the like; and pressure members, including pressure rolls, belts, films, sheets and the like; and other members useful in the fusing system of an electrostatographic or xerographic, including digital, machine. External heat member as used herein refers to heat members including heating rolls, belts, films, sheets and the like. The fuser member and the heating member of to the present invention may be employed in a wide variety of machines and are not specifically limited in application to the particular embodiment depicted herein.

Any suitable substrate may be selected for the external heat member. The external heat member substrate may be a roll, belt, flat surface, sheet, film, or other suitable shape used in the aiding in fixing of thermoplastic toner images to a suitable copy substrate. Typically, the external heat member is made of a hollow cylindrical metal core, such as copper, aluminum, stainless steel, or certain plastic materials chosen to maintain rigidity, structural integrity, as well as being capable of having a polymeric material coated thereon and adhered firmly thereto. It is preferred that the supporting substrate is a cylindrical metal roller. In one embodiment, the core, which may be an aluminum or steel cylinder, is degreased with a solvent and cleaned with an abrasive cleaner prior to being primed with a primer, such as Dow Corning 1200 and DuPont Primer 855-021, which may be sprayed, brushed or dipped, followed preferably by air drying under ambient conditions for thirty minutes and then baked at 150° C. for 30 minutes.

The outer coating of the external heat roll is preferably a fluoropolymer. Preferred fluoropolymer materials for use with the present invention include TEFLON®-like materials such as polytetrafluoroethylene (PTFE), fluorinated ethylenepropylene copolymer (FEP), perfluoroalkoxy (PFA TEFLON®), polyethersulfone, and the like, copolymers and terpolymers thereof, and mixtures thereof.

Also preferred are fluoroelastomers such as those described in detail in U.S. Pat. Nos. 5,166,031; 5,281,506; 5,366,772; 5,370,931; 4,257,699; 5,017,432; and 5,061,965, the disclosures each of which are incorporated by reference herein in their entirety. These fluoroelastomers, particularly from the class of copolymers, terpolymers, and tetrapolymers of vinylidenefluoride, hexafluoropropylene and tetrafluoroethylene and a possible cure site monomer, are known commercially under various designations as VITON A®, VITON E®, VITON E60C®, VITON E430®, VITON 910®, VITON GH® VITON GF®, VITON E45® and VITON B50®. The VITON® designation is a Trademark of E. I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS® a poly(propylene-tetrafluoroethylene) and FLUOREL II® (LII900) a poly(propylene-tetrafluoroethylenevinylidenefluoride) both also available from 3M Company, as well as the TECNOFLONS® identified as FOR-60KIR®, FOR-LHF®, NM® FOR-THF®, FOR-TFS®, TH®, TN505® available from Montedison Specialty Chemical Company. In another preferred embodiment, the fluoroelastomer is one having a relatively low quantity of vinylidenefluoride, such as in VITON GF®, available from E. I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable, known, commercially available cure site monomer.

Particularly preferred polymers for the outer layer include TEFLON®-like materials such as polytetrafluoroethylene (PTFE), fluorinated ethylenepropylene copolymer (FEP), perfluoroalkoxy (PFA TEFLON®), and mixtures thereof, due to their increased strength, and superior release properties. In a particular preferred embodiment, the outer layer comprises a mixture of PTFE and PFA Teflon®.

It is preferred that the outer polymeric external heat member layer be coated to a thickness of from about 5 to about 50 microns dry film thickness (DFT), preferably from about 10 to about 30 microns (DFT), and particularly preferred from about 18 to about 22 microns (DFT).

Preferably, the outer fluoropolymer layer has a thermal conductivity of from about 5 to about 30 BTU/(square feet)(hour)(° F./feet), and preferably from about 16 to about 26 BTU/(square feet)(hour)(° F./feet). The designation "BTU" refers to "British Standard Unit."

Although the fluoropolymer outer layer provides for increased release properties, it is preferred to add a filler to improve heat transfer or thermal conductivity. In addition, it is preferred that the fillers be substantially non-reactive with the outer polymer material so that no adverse reaction occurs between the polymer material and the filler which would hinder curing or otherwise negatively affect the strength properties of the outer surface material.

Preferred fillers include magnesium oxide, beryllium oxide, silicon carbide fillers, and the like and mixtures thereof. The filler preferably is an inorganic filler which is capable of withstanding fluoropolymer cure temperatures of up to about 435° C. without oxidizing, decomposition or emitting any gaseous by-products.

In a particularly preferred embodiment of the invention, silicon carbide is used as the filler. This filler has a very high thermal conductivity of from about 40 to about 52, and preferably from about 49 to about 52 BTU/(square feet)(hour)(° F./feet). In an even more preferred embodiment, silicon carbide fillers having a particle size of less than about 10 microns, preferably from about 1 to about 9 microns, and preferably from about 1 to about 4 microns are used in the outer layer. A relatively small particle size helps to minimize the protrusion of silicon carbide out of the coating. Normally, it is desired for outer fusing layers to have relatively larger particle size fillers. These larger particle sizes are necessary so that the particles protrude out of the fuser member coating to increase frictional forces and to increase the bonding of the fuser oil to the fuser member surface. However, the outer coating of an external heat member has different requirements. Although a conductive filler in the outer coating of an external heat member is desired in order to increase thermal conductivity, it is not desired that the filler protrude. If the filler protrudes, it will possibly cause contamination of toner from the fuser member to the external heat member. This toner will later be transferred back to the fuser member during subsequent fusing processes, resulting in toner to copy substrate contamination. In addition, protrusion of thermally conductive filler material may compromise release properties of fluoropolymer outer layers.

Preferably, the filler is present in the outer external heat member layer in an amount of from about 5 to about 35 weight percent, preferably from about 10 to about 30 weight percent by weight of total solids in the outer external heat member surface. The fluoropolymer is present in an amount of from about 95 to about 65 and preferably from about 90 to about 70 weight percent by weight of total solids. An amount of silicon carbide filler of 30 percent by weight of total solids provides a thermal conductivity of the outer fluoropolymer layer of about 16 BTU/(square feet)(hour)(° F./feet) of outer coating layer of the external heat member. This is comparable to an unloaded fluoropolymer outer layer which has a thermal conductivity of about 1.7 BTU/(square feet)(hour)(° F./feet) of outer coating layer of the external heat member. The latter thermal conductivity is not adequate.

In a preferred embodiment, a primer layer is present between the substrate and the outer layer. The primer layer has a thickness of from about 3 to about 7 microns, and preferably about 5 microns (DFT). Examples of commercially available primers include TEFLON® primers like DuPont 855-300 primer, 855-021 primer, 855-302 primer or any other suitable material that can promote adhesion of the outer fluoropolymer layer to the external heat roll substrate. In addition, an optional release agent may be used as an outer liquid layer over the outer fluoropolymer layer. Examples of suitable release agents include known polydimethyl siloxane-based release agents and fusing oils.

Other adjuvants and fillers may be incorporated in the layers in accordance with the present invention provided that they do not affect the integrity of the polymer material. Such fillers normally encountered in the compounding of elastomers include coloring agents, reinforcing fillers, and processing aids. Oxides such as magnesium oxide and hydroxides such as calcium hydroxide are suitable for use in curing many fluoropolymers.

The polymer layers of the present invention can be coated on the external fuser member substrate by any means including normal spraying, dipping and tumble spraying techniques. A flow coating apparatus as described in U.S. application Ser. No. 08/672,493 filed Jun. 26, 1996, entitled, "Flow Coating Process for Manufacture of Polymeric Printer Roll and Belt Components," the disclosure of which is hereby incorporated herein in its entirety, can also be used to flow coat a series of external heat member. It is preferred that the polymers be diluted with a solvent, and particularly an environmentally friendly solvent, prior to application to the substrate. However, alternative methods can be used for coating layer including methods described in Attorney Reference Number D/97633, U.S. application Ser. No. 08,069,476, filed Apr. 29, 1998, entitled, "METHOD OF COATING FUSER MEMBERS," the disclosure of which is hereby incorporated by reference in its entirety. In a preferred method, the fluoropolymer layer is sprayed onto the external heat member substrate using known methods.

The external heat members are useful in combination with many toners, including black and white toner or color toner. However, the external heat members herein are particularly useful with color toners. Examples of suitable known color toners include those listed in U.S. Pat. Nos. 5,620,820; 5,719,002; and 5,723,245.

The external heat members disclosed herein are particularly useful in color duplication and printing, including digital, machines. The external heat members demonstrate excellent results at the higher temperatures, for example from about 150 to about 235° C. necessary in color fusing. The external heat members, in embodiments, possess strong outer layers with increased release properties and increased thermal conductivity. Also, the external heat members, in embodiments, reduce contamination to the fuser member and provide for maintaining higher temperatures necessary in color fusing for longer periods of time. Also, in embodiments, the external heat members are particularly useful with high speed machines.

All the patents and applications referred to herein are hereby specifically, and totally incorporated herein by reference in their entirety in the instant specification.

The following Examples further define and describe embodiments of the present invention. Unless otherwise indicated, all parts and percentages are by weight of total solids as defined in the specification. Percentage by total weight refers to the amount per total weight of all the components in the particular layer in cured state with no solvents included in the calculation.

EXAMPLES

Example I

Fluoropolymer and Silicon Carbide filler in External Heat Member Fluoropolymer Outer Layer An amount of about 70 percent by weight of total solids of liquid polytetrafluoroethylene (PTFE) and perfluoroalkoxy resin (PFA) (DuPont 855-401) was mixed with 30 percent by weight of silicon carbide. A primer (DuPont Primer 855-021) was sprayed onto an aluminum cylinder, to a thickness of from about 3 to about 8 microns (DFT). This coating was cured in a cure oven. The solution of fluoropolymer and fillers was sprayed onto the surface of an aluminum cylinder coated with the primer. The thickness of the outer fluoropolymer layer was determined to be from about 18 to about 22 microns (DFT). The outer coating material was air dried and subjected to known TEFLON® curing methods in a standard cure oven.

The external heat roll was placed in a color copying machine and subjected to multiple cycles. The results of the properties of the external heat member obtained are shown in Table I below:

TABLE I

| Test Parameters | Properties |
|---|---|
| Fuser Roll Temperature | 355° F. |
| External Heat Roll Surface Temperature | 450° F. |
| Dwell of External Heat Roll/Fuser Roll Nip | 21 ms |
| Watts by Fuser Roll | 900 watts |
| Watts by External Heat Roll | 1000 watts |
| Temperature Droop | 30° F. |

The temperature droop of an external fuser member prepared in accordance with Example 1 demonstrated a drop of 30° F. as compared to a drop of 23° F. of that was obtained by testing a bare aluminum external heat member. Because the temperature before use compared to after use fell by 30° F. with an external heat member in accordance with the present invention and that of a metal roll fell by only 23° F., the temperature droop and thermal conductivity of a roller in accordance with the present invention is very similar to that of a metal roller, but without the drawbacks of a metal roller. This indicates that silicon carbide loaded fluoropolymer coatings provide excellent thermal conductivity when compared with a bare aluminum roll. In addition, silicone carbide loaded fluoropolymer coated external heat members reduce or eliminate toner contamination encountered with the aluminum un-coated roll, which can cause copy quality problems.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

I claim:

1. A fusing system comprising: an external heat member and a fuser member, wherein said external heat member comprises: a) a heat source, b) a substrate; and thereover c) an outer fluoropolymer layer comprising a fluoropolymer and particles of a thermally conductive filler and wherein said external heat member supplies heat to said fuser member, wherein protrusion of said thermally conductive filler particles from said outer fluoropolymer layer is minimized.

2. A fusing system in accordance with claim 1, wherein said conductive filler is selected from the group consisting of magnesium oxide, beryllium oxide, silicon carbide and mixtures thereof.

3. A fusing system in accordance with claim 2, wherein conductive filler is silicon carbide.

4. A fusing system in accordance with claim 1, wherein said conductive filler has a particle size of less than about 10 microns.

5. A fusing system in accordance with claim 4, wherein said conductive filler has a particle size of from about 1 to about 9 microns.

6. A fusing system in accordance with claim 5, wherein said conductive filler has a particle size of from about 1 to about 4 microns.

7. A fusing system in accordance with claim 5, wherein said filler is silicon carbide.

8. A fusing system in accordance with claim 1, wherein said filler is present in the outer layer in an amount of from about 5 to about 35 percent by weight of total solids.

9. A fusing system in accordance with claim 1, wherein said filler is present in the outer layer in an amount of from about 10 to about 30 percent by weight of total solids.

10. A fusing system in accordance with claim 1, wherein said fluoropolymer is selected from the group consisting of polytetrafluoroethylene, fluorinated ethylenepropylene copolymer, perfluoroalkoxy, and mixtures thereof.

11. A fusing system in accordance with claim 1, wherein said outer layer has a thickness of from about 5 to about 50 microns.

12. A fusing system in accordance with claim 1, wherein said substrate is a cylindrical external heat roll.

13. A fusing system in accordance with claim 1, wherein said heat source is capable of maintaining a temperature of from about 150 to about 235° C.

14. A fusing system comprising an external heat member and a fuser member, wherein said external heat member comprises a) a heat source, b) a substrate, and thereover c) an outer fluoropolymer layer comprising a fluoropolymer and a thermally conductive filler, and wherein said external heat member supplies heat to said fuser member, wherein said outer fluoropolymer layer has a thermal conductivity of from about 5 to about 30 BTU/(square feet)(hour)(° F./feet) of the outer layer.

15. A fusing system in accordance with claim 14, wherein said outer fluoropolymer layer has a thermal conductivity of from about 16 to about 26 BTU/(square feet)(hour)(° F./feet) of the outer layer.

16. A fusing system comprising an external heat member and a fuser member, wherein said external heat member comprises a) a heat source, b) a substrate, and thereover c) an outer fluoropolymer layer comprising a fluoropolymer and a thermally conductive filler, and wherein said external heat member supplies heat to said fuser member, wherein said conductive filler has a particle size of from about 1 to about 4 microns, wherein said filler is silicon carbide.

17. A fusing system comprising an external heat member and a fuser member, wherein said external heat member comprises a) a heat source, b) a substrate, and thereover c) an outer fluoropolymer layer comprising a fluoropolymer and a thermally conductive filler, and wherein said external heat member supplies heat to said fuser member, wherein said fluoropolymer is a mixture of polytetrafluoroethylene and perfluoroalkoxy.

18. An image forming apparatus for forming images on a recording medium comprising:

a charge-retentive surface to receive an electrostatic latent image thereon;

a development component to apply toner to said charge-retentive surface to develop said electrostatic latent image to form a developed image on said charge retentive surface;

a transfer component to transfer the developed image from said charge retentive surface to a copy substrate; and a fusing apparatus for fusing toner images to a surface of said copy substrate, wherein said fuser apparatus comprises a fuser member in combination with an external heat member, wherein said external heat member comprises a) a heat source, b) a substrate; and thereover c) an outer fluoropolymer layer comprising a fluoropolymer and particles of a thermally conductive filler, wherein protrusion of said thermally conductive filler particles from said outer fluoropolymer layer is minimized.

19. An image forming apparatus in accordance with claim 18, wherein said filler is silicon carbide.

20. An image forming apparatus in accordance with claim 18, wherein said toner is a color toner.

21. A fusing apparatus comprising a fuser member and an external heat member, wherein said external heat member comprises a) a heat source, b) a substrate; and thereover c) an outer fluoropolymer layer comprising a fluoropolymer and particles of silicon carbide filler, wherein protrusion of said silicon carbide filler particles from said outer fluoropolymer layer is minimized.

22. A fusing apparatus comprising a fuser member and an external heat member, wherein said external heat member comprises a) a heat source, b) a substrate; and thereover c) an outer fluoropolymer layer comprising a fluoropolymer and silicon carbide filler, wherein said silicon carbide has a particle size of from about 1 to about 4 microns.

* * * * *